US011242830B2

(12) United States Patent
Miyamoto et al.

(10) Patent No.: US 11,242,830 B2
(45) Date of Patent: Feb. 8, 2022

(54) FUEL INJECTION VALVE

(71) Applicant: Hitachi Automotive Systems, Ltd., Hitachinaka (JP)

(72) Inventors: Akiyasu Miyamoto, Hitachinaka (JP); Yasuo Namaizawa, Hitachinaka (JP); Takao Miyake, Hitachinaka (JP); Takuya Watai, Hitachinaka (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 142 days.

(21) Appl. No.: 16/646,785

(22) PCT Filed: Sep. 28, 2018

(86) PCT No.: PCT/JP2018/036213
§ 371 (c)(1),
(2) Date: Mar. 12, 2020

(87) PCT Pub. No.: WO2019/073816
PCT Pub. Date: Apr. 18, 2019

(65) Prior Publication Data

US 2020/0291910 A1 Sep. 17, 2020

(30) Foreign Application Priority Data

Oct. 13, 2017 (JP) ..... JP2017-199517

(51) Int. Cl.
*F02M 51/06* (2006.01)

(52) U.S. Cl.
CPC ..... *F02M 51/0625* (2013.01)

(58) Field of Classification Search
CPC ..... F02M 51/0625; F02M 51/0664
(Continued)

(56) References Cited

U.S. PATENT DOCUMENTS 6,510,841 B1 1/2003 Stier
8,371,515 B2 * 2/2013 Abe ..... F02M 61/205 239/585.2

(Continued)

FOREIGN PATENT DOCUMENTS

JP 2003-511604 A 3/2003
JP 2013-167194 A 8/2013

(Continued)

OTHER PUBLICATIONS

International Search Report with English translation and Written Opinion issued in corresponding application No. PCT/JP2018/036213 dated Jan. 22, 2019.

*Primary Examiner* — Hai H Huynh
(74) *Attorney, Agent, or Firm* — Foley & Lardner LLP

(57) ABSTRACT

Provided is a fuel injection valve capable of quickly stopping a position of a movable element at a predetermined position after closing a valve while reducing an impact force of a valve body. Therefore, a valve body 101 includes a sleeve 113. A first movable core 201 (first movable element) lifts the valve body 101 by the attractive force of a magnetic core 107. A second movable core 202 (second movable element) further lifts the valve body 101 by the attractive force of the magnetic core 107 after the first movable core 201 (first movable element) lifts the valve body 101. After the valve body 101 is seated on the seat member 102 and the second movable core 202 (second movable element) is separated from the sleeve 113, a bottom surface 201*g* of the first movable core 201 (first movable element) collides with a storage bottom surface 111*b* (collision receiving portion).

10 Claims, 10 Drawing Sheets

(58) Field of Classification Search
USPC ..... 123/490; 251/129.15
See application file for complete search history.

(56) References Cited

U.S. PATENT DOCUMENTS

| | | | |
|---|---|---|---|
| 2015/0204289 | A1 | 7/2015 | Agresta |
| 2015/0354515 | A1 | 12/2015 | Yasukawa |

FOREIGN PATENT DOCUMENTS

| | | | |
|---|---|---|---|
| JP | 2014-141924 | A | 8/2014 |
| JP | 2015-224596 | A | 12/2015 |
| JP | 2016-118208 | A | 6/2016 |

* cited by examiner (a) DRIVE CURRENT VALUE AND VALVE BODY DISPLACEMENT AT SMALL LIFT (b) DRIVE CURRENT VALUE AND VALVE BODY DISPLACEMENT AT LARGE LIFT

FUEL INJECTION VALVE

TECHNICAL FIELD

The present invention relates to a fuel injection valve.

BACKGROUND ART

As a related art in this technical field, there is a fuel injection valve described in PTL 1 below.

PTL 1 discloses a configuration "In order to provide a fuel injection valve capable of changing the fuel injection rate with a simple structure, a fuel injection valve includes a fixed core, a needle, a movable core, and a coil which generates a magnetic attractive force among the needle, the movable core, and the fixed core. The needle has a large-diameter portion of the needle formed of a magnetic material and having a larger outer diameter than the main body. The movable core is provided on the valve seat side of the fixed core such that the movable core can reciprocate in the housing together with the needle in a state where the large diameter portion of the needle is located inside the large diameter inner wall surface and the main body is located inside the small diameter inner wall surface. When the movable core is in contact with the seal portion and the valve seat, the distance between the second step surface of the needle and the end surface of the fixed core on the valve seat side is longer than the distance between the end surface on the opposite side to the valve seat and the end surface of the fixed core."

CITATION LIST

Patent Literature

PTL 1: JP 2016-118208 A

SUMMARY OF INVENTION

Technical Problem

In order to reduce harmful exhaust components of an internal combustion engine, a fuel injection valve for accurately injecting a desired amount of fuel into an engine (internal combustion engine) is required. The fuel injection valve described in PTL 1 injects fuel from an injection hole using a magnetic attractive force generated by energizing a coil. In such a fuel injection valve, when the coil is energized, the magnetic attractive force is generated between a magnetic core and the movable core. When the movable core is drawn toward the magnetic core by the magnetic attractive force generated between the movable core and the magnetic core, the force is transmitted to the valve body, and the valve body moves in a direction away from the valve seat. The movement of the movable core and the valve body is restricted by collision with the magnetic core, and the movable core and the valve body stop. During this valve opening period, fuel is supplied to the internal combustion engine and used for combustion.

Thereafter, when the energization of the coil is stopped, the magnetic flux formed between the magnetic core and the movable core disappears, and when the magnetic attractive force becomes smaller than the force urging the valve body in a downstream direction (the valve closing direction), the valve body starts moving in the downstream direction (valve closing direction), and then closes.

Here, in the technique disclosed in PTL 1, the valve body also functions as a movable core, and the lift amount of the valve body can be changed by changing the value of the current supplied to the coil. However, the valve body has a large impact force against the valve seat when the valve is closed.

On the other hand, in order to reduce the error of the fuel injection amount, there is a demand that the position of the movable element be quickly stopped at a predetermined position after the valve is closed.

An object of the invention is to provide a fuel injection valve capable of quickly stopping a movable element at a predetermined position after the valve is closed while reducing the impact force of the valve body.

Solution to Problem

In order to achieve the above object, the invention provides a fuel injection valve which includes a valve body having a sleeve, a seat member on that the valve body is seated, a magnetic core, a first movable element that lifts the valve body by an attractive force of the magnetic core, a second movable element that is configured separately from the valve body and further lifts the valve body by the attractive force of the magnetic core after the first movable element lifts the valve body, and a collision receiving portion that collides with a bottom surface of the first movable element after the valve body is seated on the seat member and the second movable element separates from the sleeve.

Advantageous Effects of Invention

According to the invention, the position of the movable element can be quickly stopped at a predetermined position after closing the valve while reducing the impact force of the valve body. Objects, configurations, and effects besides the above description will be apparent through the explanation on the following embodiments.

DESCRIPTION OF EMBODIMENTS

A fuel injection valve (fuel injection device) of this embodiment will be described below with reference to FIGS. 1 to 12.

Figure 1:
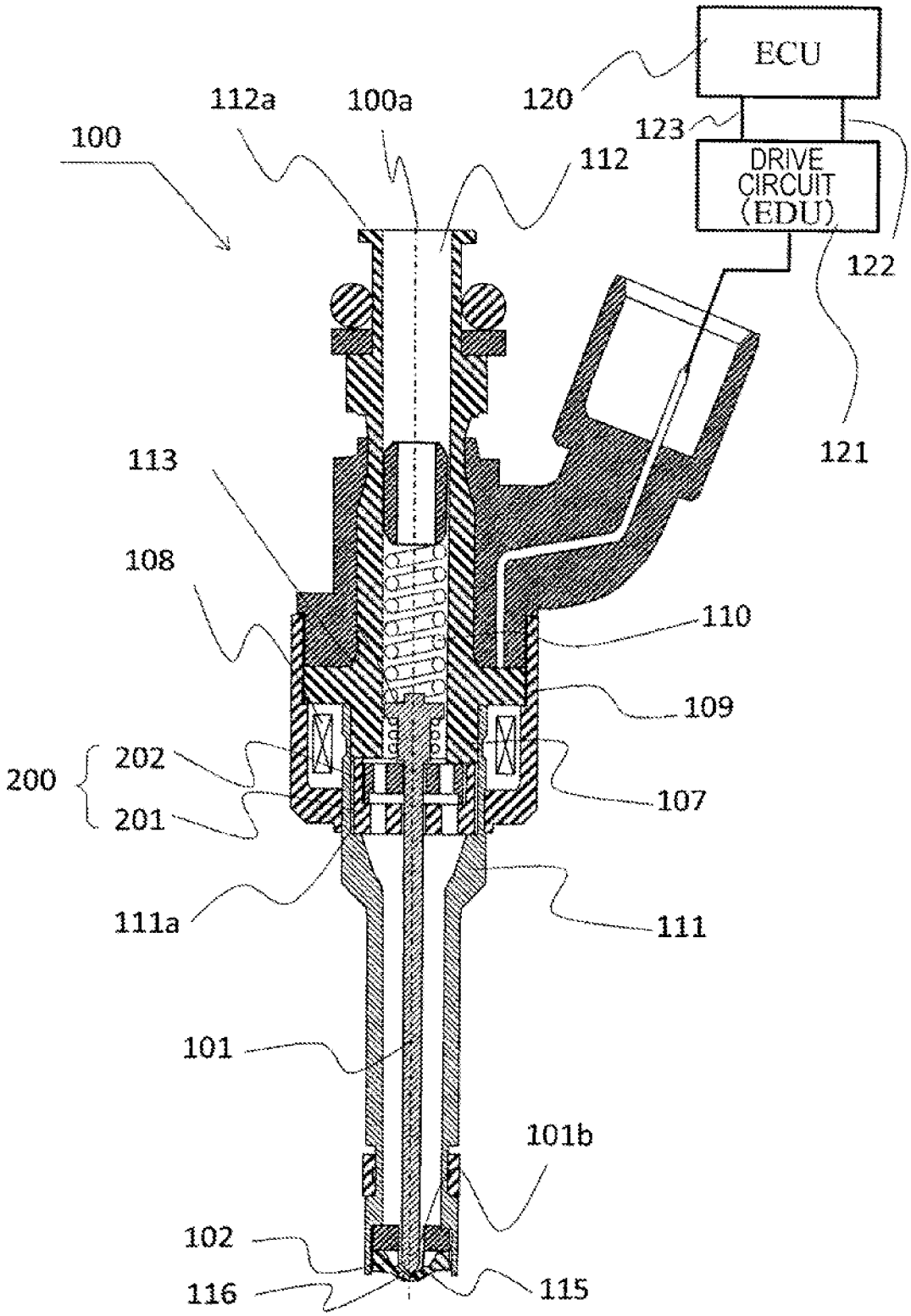
FIG. 1 is a cross-sectional view of a fuel injection valve according to an embodiment of the invention.

FIG. 1 is a cross-sectional view illustrating the structure of a fuel injection valve 100 of this embodiment. Specifically, FIG. 1 is a longitudinal cross-sectional view of the fuel injection valve 100, and a diagram illustrating an example of the configuration of an EDU 121 (drive circuit) for driving the fuel injection valve 100 and an ECU 120 (engine control unit). Further, in this embodiment, for convenience, a fuel supply port 112 side is defined as an upstream side, and a seat member 102 (valve seat) side is defined as a downstream side in an axial direction 100*a* of the fuel injection valve 100.

Although the fuel injection valve 100 in FIG. 1 is an example of an electromagnetic fuel injection valve for an in-cylinder direct injection type gasoline engine, the invention is also effective to an electromagnetic fuel injection valve for a port injection type gasoline engine and an electromagnetic fuel injection valve for diesel engines. Further, the ECU 120 and the EDU 121 may be configured as an integral component. At least a drive circuit for the fuel injection valve 100 is a device that generates a drive voltage for the fuel injection valve 100, and may be a device with the ECU and EDU integrated, or may be a single EDU.

The ECU 120 receives signals indicating the state of the engine (internal combustion engine) from various sensors, and calculates an appropriate drive pulse width and injection timing according to the driving conditions of the engine. The drive pulse output from the ECU 120 is input to the EDU 121 of the fuel injection valve 100 through a signal line 123. The EDU 121 controls a voltage applied to a coil 108 and supplies a current to the coil 108. The ECU 120 communicates with the EDU 121 through a communication line 122, and can switch a drive current generated by the EDU 121 according to a pressure of fuel supplied to the fuel injection valve 100 and driving conditions. The EDU 121 can change a control constant by communicating with the ECU 120, and the waveform of the current supplied to the coil 108 changes according to the control constant.

First, the overall configuration of the fuel injection valve 100 and the flow of fuel will be described. In the case of the in-cylinder direct injection type electromagnetic fuel injection valve for a gasoline engine, a metal pipe forming the fuel supply port 112 is attached to a common rail (not illustrated).

The common rail is supplied with high-pressure fuel from a high-pressure fuel pump (not illustrated) and stores high-pressure fuel at a set pressure (for example, 35 MPa). Then, the high-pressure fuel of the common rail is supplied to the inside of the fuel injection valve 100 via the fuel inlet surface 112*a* of the fuel supply port 112. The fuel injection valve 100 includes a valve body 101 that opens and closes a flow path inside, and the seat member 102 having a conical surface is provided at a position facing the downstream end portion of the valve body 101. The seat member 102 is formed with a seat portion 115 that seals fuel when a valve body-side seat portion 101*b* of the valve body 101 is seated, and a fuel injection hole 116 through which fuel is injected on the downstream side of the seat portion 115. In other words, the valve body 101 sits on the seat member 102.

When the coil 108 is not energized, the valve body 101 is pressed against the seat member 102 by a first spring 110, abuts on the seat portion 115 to form a seal seat, and seals fuel.

Figure 2:
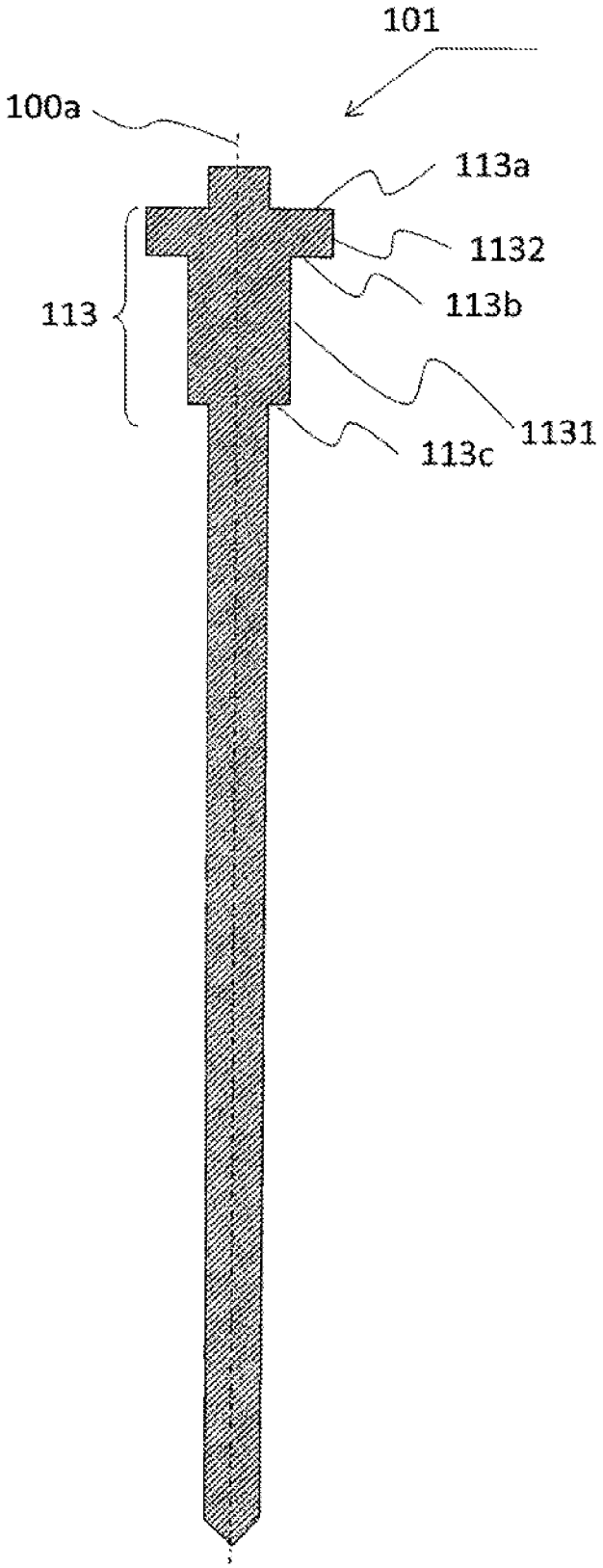
FIG. 2 is a cross-sectional view of a valve body of the fuel injection valve according to the embodiment of the invention.

FIG. 2 illustrates a longitudinal cross-sectional view of the valve body 101 of this embodiment. A sleeve 113 (engaging portion) is attached to the upstream end portion of the valve body 101. In other words, the valve body 101 includes the sleeve 113. The sleeve 113 has a cylindrical portion 1131 attached to the outer diameter side of a small diameter portion of the valve body, and a convex portion 1132 which is convex at the upper end of the sleeve 113 toward the outer diameter side.

An urging force of the first spring 110 is transmitted to the valve body 101 via a convex top surface 113*a* of the sleeve 113, and the valve body 101 is urged in the downstream direction (the direction toward the seat member 102).

As illustrated in FIG. 1, the magnetic circuit is formed by a movable core group 200, a magnetic core 107, the coil 108 located on the outer peripheral side of the magnetic core 107, and a yoke 109 (housing) located on the outer diameter side of the coil. The valve body 101 is driven by generating a magnetic attractive force between the magnetic core 107 and the movable core group 200.

The movable core group 200 is divided into a first movable core 201 (first movable element: outer anchor) and a second movable core 202 (second movable element: inner anchor). The valve body 101 and the movable core group 200 (the first movable core 201 and the second movable core 202) are included in a storage portion 111*a* (storage concave portion) of a nozzle holder 111 (cylindrical member). Further, the valve body 101 that is opened by the first movable core 201 or the second movable core 202 is configured separately and independently from the first movable core 201 and the second movable core 202.

As a result, as described later, the lift amount of the valve body 101 can be changed by changing the current value supplied to the coil 108, and the impact force of the valve body 101 on the seat member 102 can be reduced.

Figure 3:
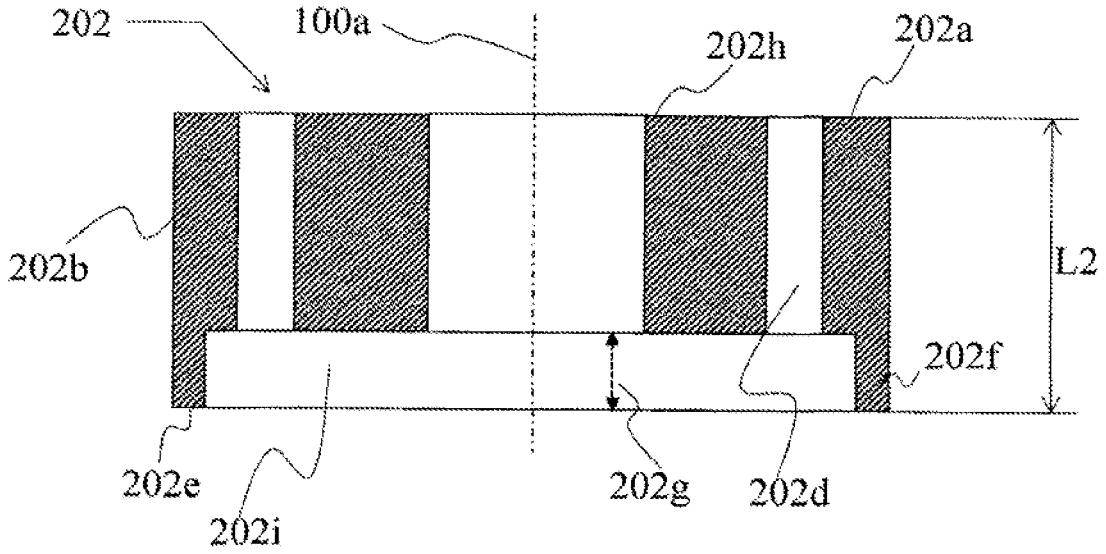
FIG. 3 is a cross-sectional view of a second movable core illustrated in FIG. 1.
Figure 4:
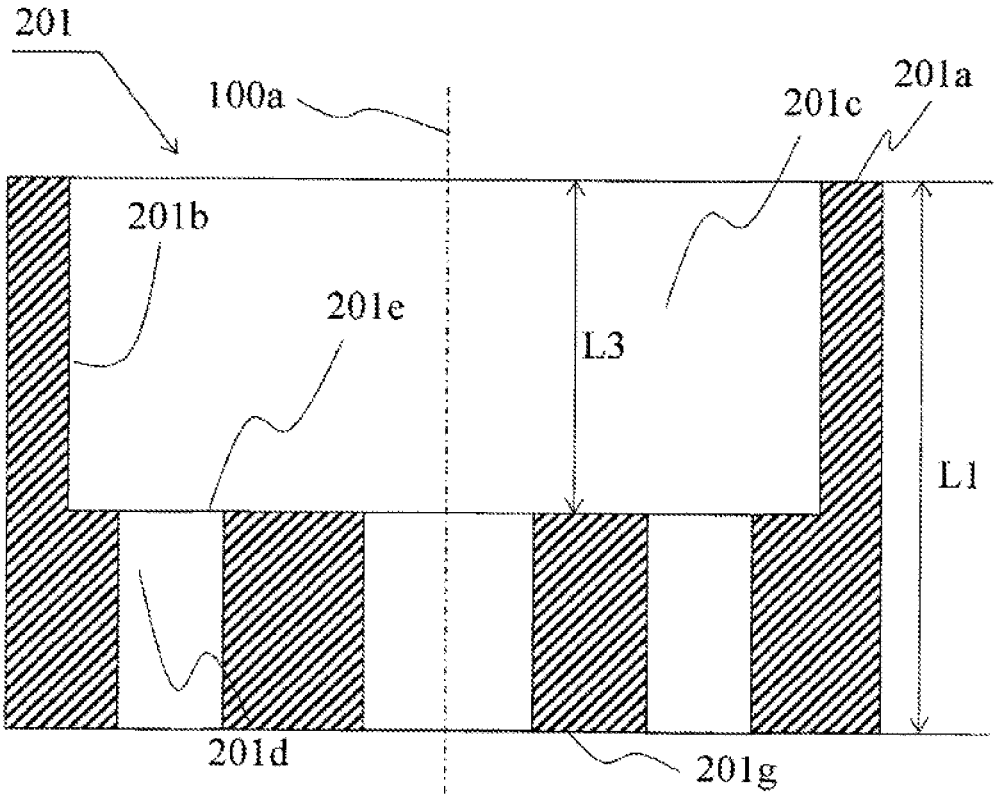
FIG. 4 is a cross-sectional view of a first movable core illustrated in FIG. 1.

FIGS. 3 and 4 are longitudinal cross-sectional views of the movable core group, and the positional relation of the movable core group 200 is illustrated using these. When a drive current flows from the EDU 121 (drive circuit) to the coil 108, a magnetic attractive force is generated between the magnetic core 107 (FIG. 1) and the first movable core 201 and the second movable core 202. The first movable core 201 engages with the second movable core 202 via a concave bottom surface 201*e* of the first movable core and a bottom surface 202*e* of the second movable core 202, and the second movable core 202 is driven toward the magnetic core 107 when the first movable core 201 moves to face the magnetic core 107.

Thereby, the sleeve 113 of the valve body 101 is configured to engage with the second movable core 202 and be opened by the first movable core 201. When the coil 108 is not energized, a bottom surface 201*g* of the first movable core 201 comes into contact with a storage bottom surface 111*b* of the storage portion 111*a* of the nozzle holder 111, and the movement of the first movable core 201 is restricted.

Figure 5:
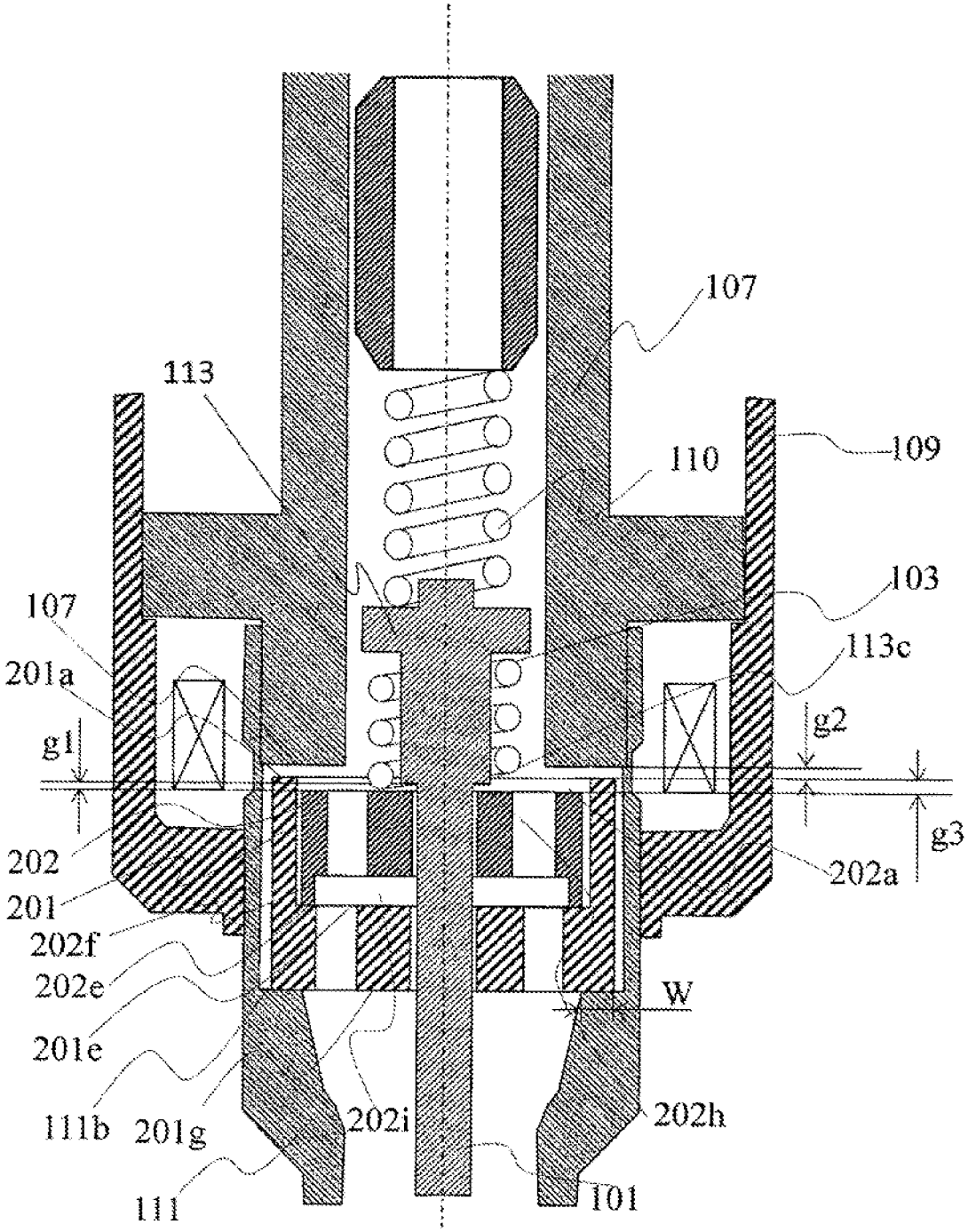
FIG. 5 is a cross-sectional view illustrating a positional relation of a movable core group when not powered up.

As illustrated in FIG. 5, the first movable core 201 has a first facing surface 201*a* facing the magnetic core 107, and the first facing surface 201*a* is attracted to the magnetic core 107. The second movable core 202 is formed separately from the first movable core 201, has a second facing surface

202*a* facing the magnetic core 107, and is configured such that the second facing surface 202*a* is attracted to the magnetic core 107.

In this embodiment, a concave portion 202*i* is formed in the bottom surface 202*e* of the second movable core 202. As a result, a protrusion 202*f* is formed, and even when the valve is closed, the protrusion 202*f* abuts on the bottom surface of the concave portion 201*c* of the first movable core 201, thereby forming a gap 202*g* (FIG. 3) between the second movable core 202 and the bottom surface of the concave portion 201*c*. Further, the second facing surface 202*a* of the second movable core 202 is arranged on the inner peripheral side with respect to the first facing surface 201*a* of the first movable core 201.

An inner periphery 201*b* of the first movable core 201 is configured to face an outer periphery 202*b* of the second movable core 202 in a direction orthogonal to the axial direction 100*a*. The first movable core 201 has a concave portion 201*c* (storage concave portion) for storing the second movable core 202 on the inner peripheral side toward the downstream side, and the second movable core 202 is included inside the concave portion 201*c*. In the axial direction 100*a* (axial direction of the valve body), the concave bottom surface 201*e* of the first movable core 201 is configured to face the bottom surface 202*e* of the second movable core 202.

At this time, the length relation between the first movable core 201 and the second movable core 202 in the valve body axial direction (the axial direction 100*a*) is such that the maximum axial length L1 of the first movable core 201 is configured to be longer than the maximum axial length L2 of the second movable core 202. Also, the depth L3 of the concave portion 201*c* of the first movable core 201 is configured to be longer than the maximum axial length L2 of the second movable core 202.

The valve body 101 has a sleeve bottom surface 113*c* (valve body engaging portion) that engages with an upstream side engaging portion 202*h* and drives the valve body 101 on the upstream side of the second movable core 202. In a case where the second movable core 202 moves to the upstream side, the valve body 101 is moved to the upstream side (valve opening direction) by the sleeve bottom surface 113*c*.

The first movable core 201 has a first engaging portion (the concave bottom surface 201*e*) that engages with the second movable core 202. When the first movable core 201 moves in the upstream direction, the first engaging portion (the concave bottom surface 201*e*) of the first movable core 201 and a second engaging portion (the bottom surface 202*e*) of the second movable core 202 are engaged to move the second movable core 202 in the upstream direction. When the second movable core 202 moves in the upstream direction, the upstream side engaging portion 202*h* and the convex bottom surface 113*b* of the sleeve 113 are engaged, and the valve body 101 is moved to the upstream side.

The first movable core 201 and the second movable core 202 have a fuel passage hole 201*d* and a fuel passage hole 202*d*, respectively, in order to reduce a fluid force generated when moving. The area of the fuel passage hole 201*d* and the hole of the fuel passage hole 202*d* in the vertical direction in the axial direction 100*a* (the axis of the valve body) is sufficient to mitigate a fluid force caused by an excluded area when the first movable core 201 (movable core on the outer diameter side) and the second movable core 202 (movable core on the inner diameter side) operate.

As illustrated in FIG. 1, the nozzle holder 111 includes the storage portion 111*a* for housing the movable core group 200 (movable element group), and as illustrated in FIG. 5, the storage bottom surface 111*b* is provided on the bottom side (downstream side) of the storage portion 111*a*. In a state where no power is supplied, the first movable core 201 is urged to the downstream side by the urging force of a second spring 103, so that the bottom surface 201*g* of the first movable core 201 and the storage bottom surface 111*b* come into contact with each other.

Next, referring to FIGS. 5 to 9, the relation between the air gap provided between the valve body 101, the first movable core 201, and the second movable core 202, and the operation of the member when a current is applied to the coil 108 will be described.

FIG. 5 illustrates a state where the coil 108 is not energized. While not illustrated, in this state, the valve body 101 comes into contact with a valve seat provided on the seat member 102 to be in a closed state.

The second spring 103 urges the second movable core 202 in a direction (downward) to separate the second movable core 202 from the sleeve bottom surface 113*c* of the sleeve 113 attached to the valve body 101. The second movable core 202 is urged in the downstream direction by the second spring 103, and the urging force of the second spring 103 is transmitted to the first movable core 201 through the bottom surface 202*e* of the second movable core 202 and the concave bottom surface 201*e* (the first concave bottom surface).

The first movable core 201 urged to the downstream side is configured such that the bottom surface 201*g* of the first movable core 201 and the storage bottom surface 111*b* are in contact with each other. Therefore, the bottom surface 202*e* of the second movable core 202 and the concave bottom surface 201*e* (the first engaging portion) of the first movable core 201 come into contact with each other, and the second movable core 202 is kept separated from the sleeve bottom surface 113*c* of the sleeve 113 which is attached to the valve body 101. At this time, a gap g1 is provided between the second facing surface 202*a* of the second movable core 202 and the sleeve bottom surface 113*c*.

Further, the second movable core 202 (second movable element) is arranged in a concave portion 201*c* formed in the first movable core 201 (first movable element). When the valve is closed, the first gap (gap g2) between the first movable core 201 and the magnetic core 107, and the second gap (gap g2+gap g3) between the second movable core 202 and the magnetic core 107 is larger. Thus, as described later, the lift amount of the valve body 101 can be changed by changing the value of the current supplied to the coil 108.

From the state of FIG. 5, when the coil 108 is energized, a magnetic flux is generated in the magnetic core 107, the yoke 109, and the first movable core 201, and the second movable core 202 which form the magnetic circuit, and a magnetic attractive force is generated between the magnetic core 107 and the first movable core 201 and the second movable core 202 and the magnetic core 107.

As illustrated in Expression (1), when the sum of a magnetic attractive force Fo acting between the first movable core 201 and the magnetic core 107 and a magnetic attractive force Fi acting between the second movable core 202 and the magnetic core 107 is larger than an urging force Fz of the second spring 103, the first movable core 201 and the second movable core 202 are attracted to the magnetic core 107 and start to move.

[Math. 1]

$$Fo+Fi>Fz \quad (1)$$

Figure 6:
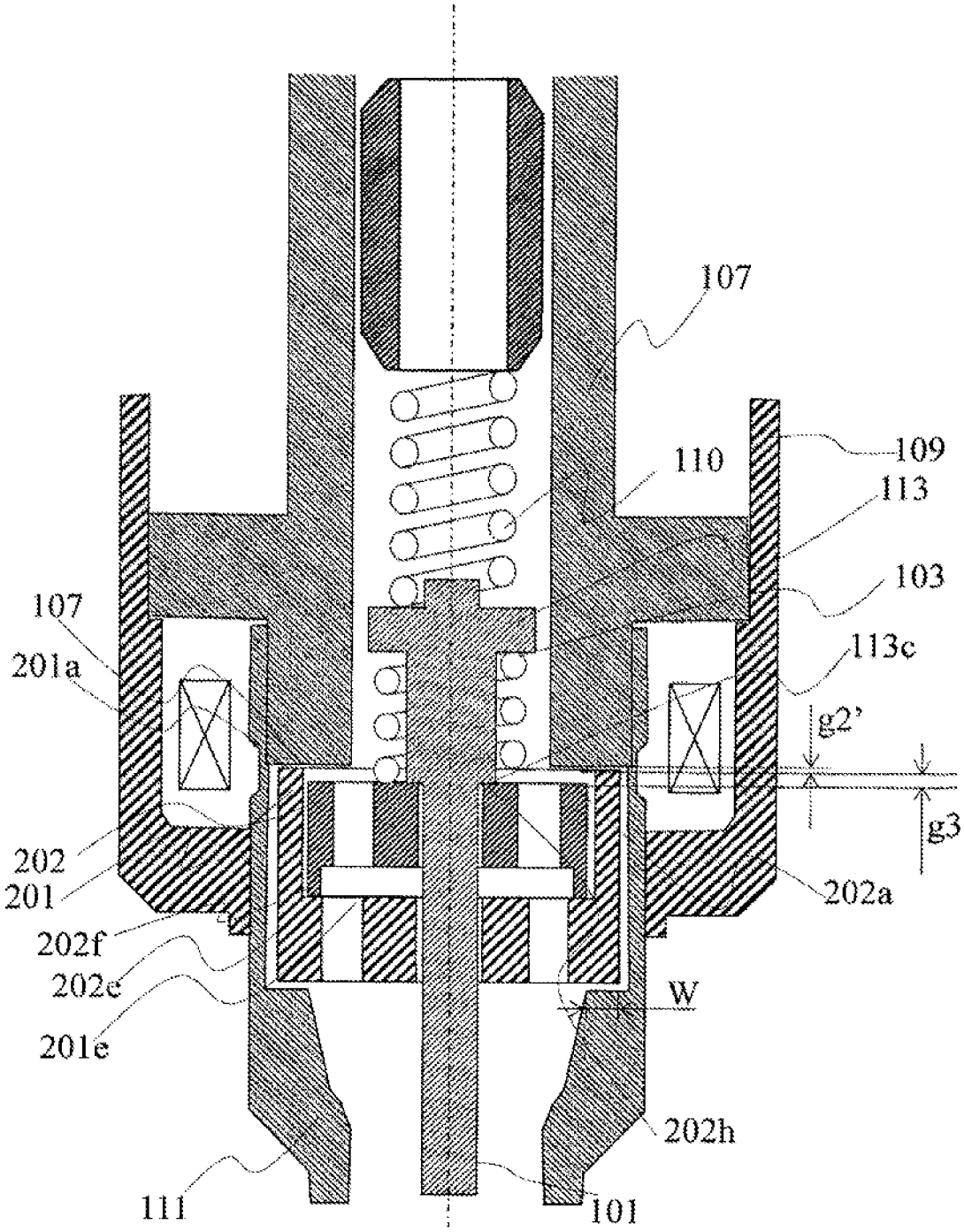
FIG. 6 is a diagram illustrating a state where the first movable core and the second movable core are displaced by a gap g1.

FIG. 6 illustrates a state where the second movable core 202 (movable core on the inner diameter side) and the first movable core 201 (movable core on the outer diameter side) are displaced by the gap g1 provided in advance between the sleeve bottom surface 113*c* and the second movable core 202 (movable core on the inner diameter side). In FIG. 5, the gap g2 is provided between the magnetic core 107 and the first facing surface 201*a* of the first movable core 201 (movable core on the outer diameter side), but in FIG. 6, the gap therebetween is reduced down to g2' (g2'=g2−g1). The sleeve bottom surface 113*c* (collision surface) of the sleeve 113 of the valve body 101 and the second facing surface 202*a* (end surface on the upstream side) of the second movable core 202 collide.

At this time, the kinetic energy stored in the first movable core 201 and the second movable core 202 is used for the valve opening operation of the valve body 101. Therefore, the kinetic energy can be utilized by setting the gap g1 (preliminary lift), and the responsiveness of the valve opening operation can be improved. Therefore, the valve can be quickly opened even under a high fuel pressure.

Figure 7:
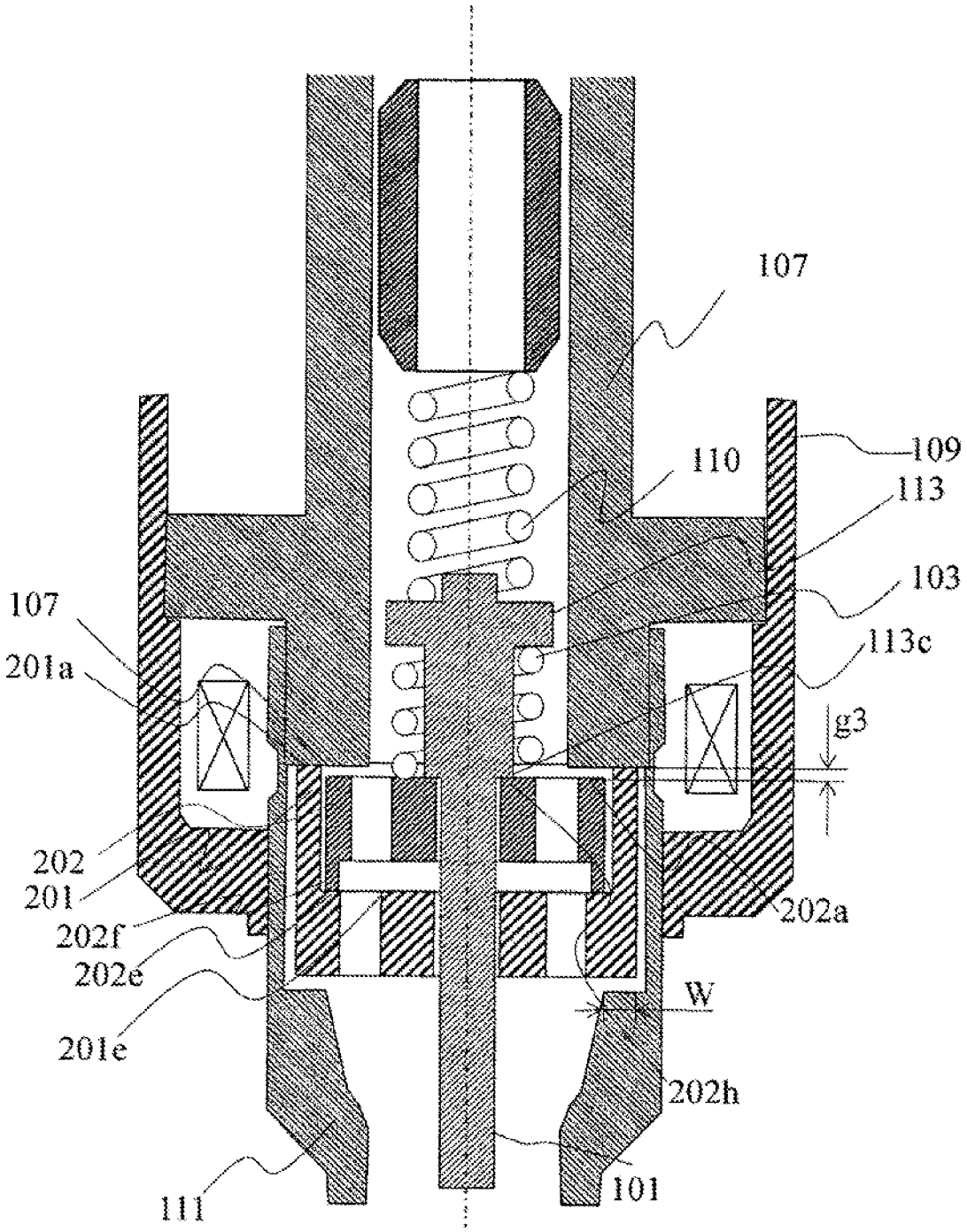
FIG. 7 is a diagram illustrating a state in which the first movable core and the second movable core are displaced by a gap g2' from the state illustrated in FIG. 6.

When the energization to the coil 108 is continued from the state of FIG. 6 and the first movable core 201 is displaced by the gap g2' between the first facing surface 201*a* and the magnetic core 107, the state illustrated in FIG. 7 is obtained. In FIG. 7, the first facing surface 201*a* of the first movable core 201 collides with the magnetic core 107, and the movement of the first movable core 201 in the upstream direction is restricted.

Figure 9:
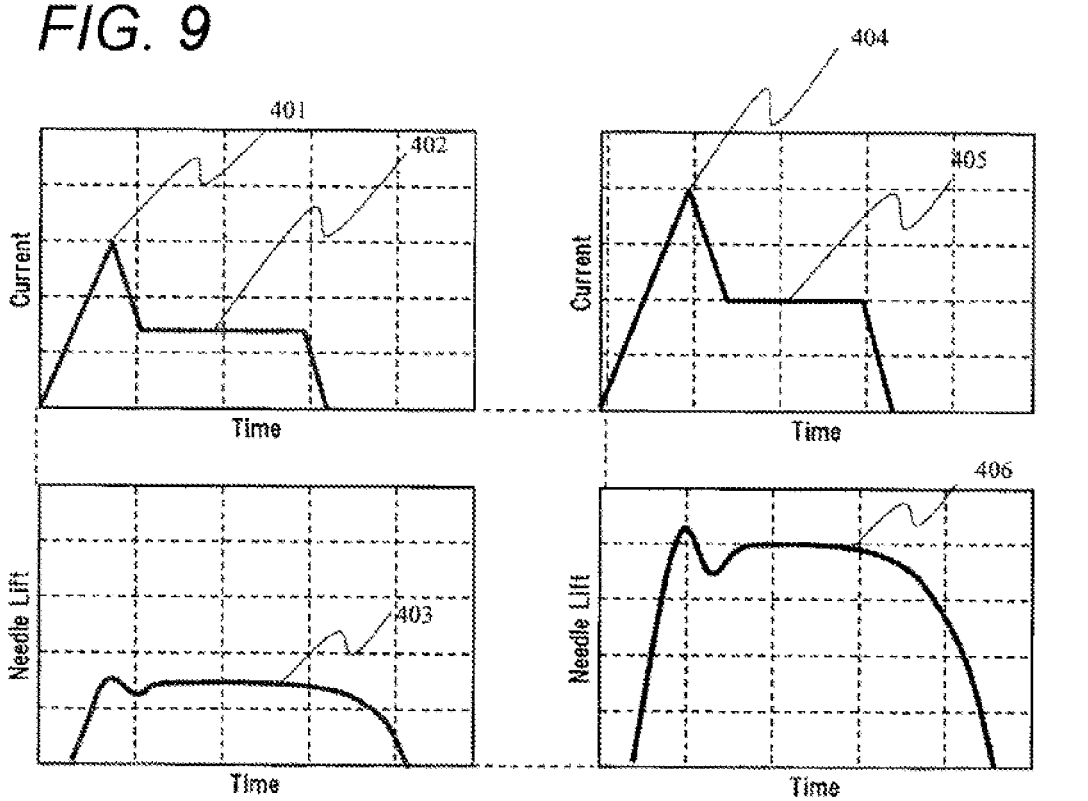
FIG. 9 is a diagram illustrating a drive current value and a valve body displacement during a small lift and a large lift.

At this time, as illustrated in FIG. 9(*a*), when a maximum drive current 401 to be supplied to the coil 108 is made smaller than a predetermined threshold value, the relation between the forces of Expressions (2) and (3) is satisfied. Further, reference numeral 402 denotes a holding current that can maintain the first movable core 201 (movable core on the outer diameter side) being attracted to the magnetic core 107 after the maximum drive current 401 flows.

Equation (2) indicates a condition that the sum of the magnetic attractive force Fo of the first movable core 201 and the magnetic attractive force Fi of the second movable core 202 is larger than the sum of the difference between the differential pressure Fp due to the fluid acting on the valve body 101 and the first spring 110, an urging force Fs of the first spring 110, and an urging force (−Fz) of the second spring 103. In addition, Equation (3) indicates a condition that the magnetic attractive force Fi of the second movable core 202 is smaller than the sum of the differential pressure Fp due to the fluid acting on the valve body 101 and the urging force Fs of the first spring 110.

In other words, the magnetic attractive force Fo by the first movable core 201 and the magnetic attractive force Fi by the second movable core 202 overcome the differential pressure Fp caused by the fluid acting on the valve body 101 and the urging force Fs of the first spring 110, so that the first movable core 201 can move until abutting on the magnetic core 107. However, this means that the magnetic attractive force Fi of the second movable core 202 (movable core on the inner diameter side) alone cannot overcome the differential pressure Fp and the urging force Fs of the first spring 110. Therefore, as illustrated in FIG. 7, there is no gap between the first movable core 201 and the magnetic core 107, and only the gap g3 between the second movable core 202 and the magnetic core 107 remains. FIG. 9(*a*) corresponds to FIG. 7, and illustrates a small lift state.

[Math. 2]

$$Fs-Fz+Fp<Fi+Fo \quad (2)$$

[Math. 3]

$$Fs+Fp>Fi \quad (3)$$

When the current to the coil 108 is cut off from the state illustrated in FIG. 7 (small lift state), the magnetic flux generated between the magnetic core 107 and the first movable core 201 and the second movable core 202 disappears. When the magnetic attractive force is smaller than the differential pressure Fp due to the fluid acting on the valve body 101 and the urging force Fs by the first spring 110, the first movable core 201 (movable core on the outer diameter side) and the second movable core 202 start to be displaced in the downstream direction. With this movement, the valve body 101 starts to be displaced in the valve closing direction (downstream direction), and then collides with the seat member 102 to close the valve.

In the case of a small lift, as illustrated in FIG. 9(*a*), the valve body 101 is displaced an amount obtained by subtracting the gap g1 from the gap g2 provided between the first movable core 201 and the magnetic core 107 (g2'=g2−g1) (valve body displacement 403). In other words, the first movable core 201 (first movable element) lifts the valve body 101 by the attractive force of the magnetic core 107 (gap g2').

Specifically, when the first movable core 201 (first movable element) is attracted to the magnetic core 107, the first movable core 201 (first movable element) is engaged with the second movable core 202 (second movable element). When the second movable core 202 is engaged with the valve body 101, the valve body 101 is lifted. More specifically, when the first movable core 201 (the first movable element) is attracted to the magnetic core 107, the concave bottom surface 201*e* (bottom surface) of the concave portion 201*c* formed in the first movable core 201 is engaged with the bottom surface 202*e* of the second movable core 202 (second movable element). The upstream side engaging portion 202*h* (top surface) of the second movable core 202 is engaged with the sleeve bottom surface 113*c* (bottom surface) of the sleeve 113 of the valve body 101, so that the valve body 101 is lifted.

In this way, after the first movable core 201 (first movable element) lifts the valve body 101, the upstream side engaging portion 202*h* (top surface) of the second movable core 202 (second movable element) is engaged with the sleeve bottom surface 113*c* (bottom surface) of the sleeve 113 of valve body 101, so that the valve body 101 is lifted.

The first movable core 201 (movable core on the outer diameter side) collides with the magnetic core 107 or a member other than the magnetic core 107 that regulates the movement of the first movable core, whereby the displacement in the axial direction is regulated. With this configuration, it possible to stabilize the lift amount of the valve body 101, so that a stable injection amount can be supplied.

On the other hand, as illustrated in FIG. 9(*b*), when a maximum drive current 404 (maximum drive current value) to be supplied to the coil 108 is larger than a predetermined threshold value, the condition illustrated in Expression (4) is satisfied. Further, reference numeral 405 denotes a holding current that can maintain the first movable core 201 (movable core on the outer diameter side) being attracted to the magnetic core 107 after the maximum drive current 404 flows. Equation (4) indicates a condition that the magnetic attractive force Fi of the second movable core 202 (movable core on the inner diameter side) is larger than the sum of the differential pressure Fp due to the fluid acting on the valve body 101 and the urging force Fs of the first spring 110.

Figure 8:
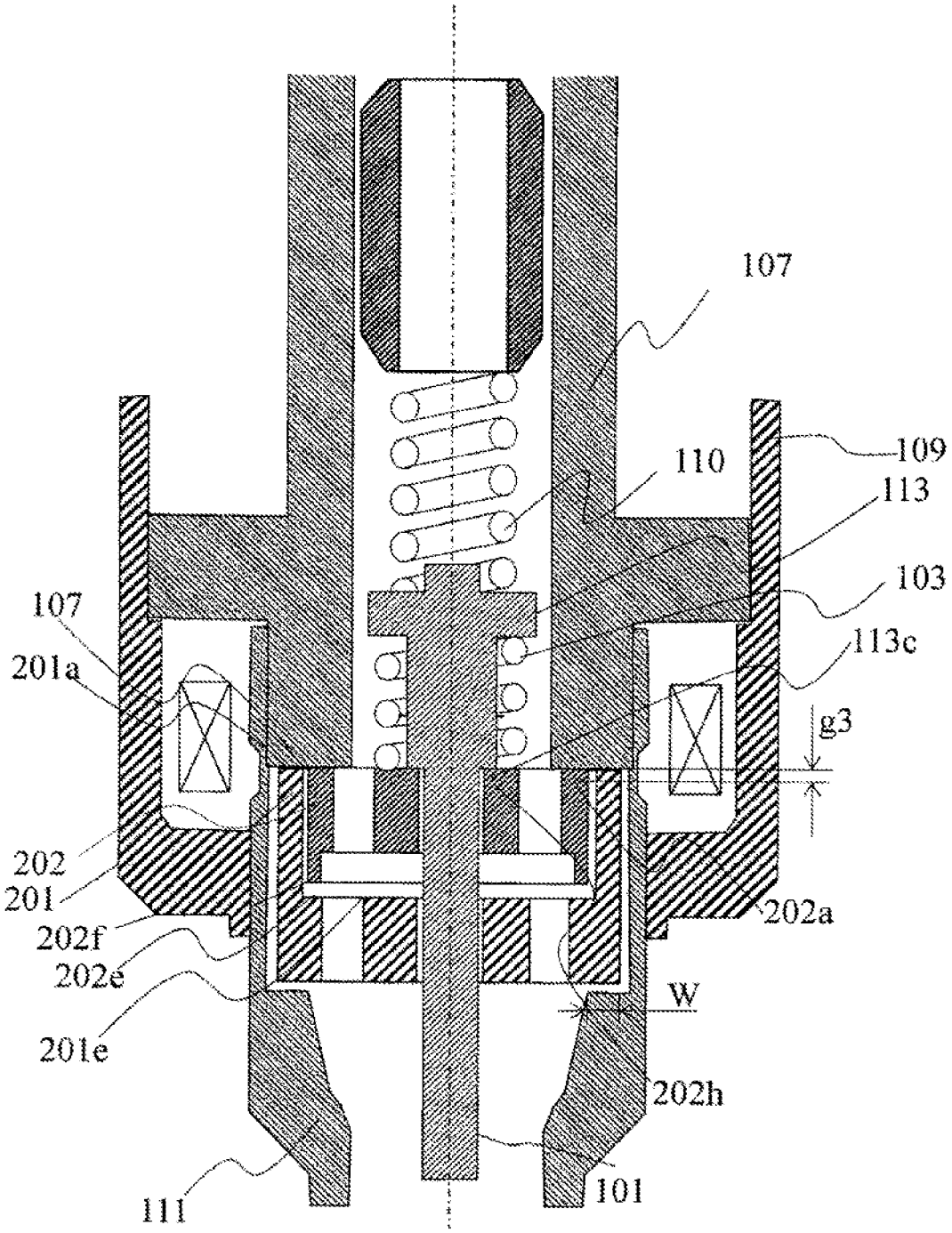
FIG. 8 is a diagram illustrating a state in which the second movable core has been displaced by a gap g3 from the state of FIG. 7.

When the drive current illustrated in FIG. 9(*b*) flows, as illustrated in FIG. 8, the movement is made by the gap g2 (see FIGS. 5 and 9(*a*)) until the first movable core 201 (movable core on the outer diameter side) collides with the magnetic core 107. Then, the second movable core 202 (movable core on the inner diameter side) is displaced by the gap g3 between the second movable core 202 (movable core on the inner diameter side) and the magnetic core 107. As a result, the valve body 101 is displaced by the sum of the gap g2' (g2'=g2−g1) and the gap g3 (large lift state).

In other words, the second movable core 202 (second movable element) further lifts the valve body 101 by the attractive force of the magnetic core 107 after the first movable core 201 (first movable element) lifts the valve body 101 (gap g3). Here, the second movable core 202 is configured separately from the valve body 101. Thereby, the impact force of the valve body 101 on the seat member 102 can be reduced as compared with the technique disclosed in PTL 1.

The displacement of the second movable core 202 is regulated by colliding with the member that regulates the movement of the magnetic core 107 or the second movable core 202. Therefore, the behavior of the valve body 101 is stable, and a stable injection amount can be supplied.

[Math. 4]

$$Fs+Fp<Fi \quad (4)$$

When the current to the coil 108 is cut off from the large lift state illustrated in FIGS. 8 and 9(*b*), the magnetic flux generated in the second movable core 202 (movable core on the inner diameter side) disappears. When the magnetic attractive force becomes smaller than the differential pressure Fp due to the fluid acting on the valve body 101 and the urging force Fs of the first spring 110, the second movable core 202 (movable core on the inner diameter side) is displaced in the downstream direction.

In addition to the magnetic flux starting to disappear from the inner diameter side, due to the differential pressure Fp and the urging force Fs by the first spring 110, the operation of the second movable core 202 (movable core on the inner diameter side) shifts to the valve closing operation earlier than the first movable core 201 (movable core on the outer diameter side). As a result, when the second movable core 202 (movable core on the inner diameter side) moves downstream by the gap g3 with the first movable core 201 (movable core on the outer diameter side), the second movable core 202 collides with the first movable core 201 (movable core on the outer diameter side). The valve body 101 and the second movable core 202 are displaced in the downstream direction while knocking down the first movable core 201 (movable core on the outer diameter side). The valve body 101 starts the valve closing operation, and eventually collides with the seat member 102 to close the valve.

As a result, as illustrated in FIG. 9(*b*), the valve body 101 has a valve displacement 406 in a large lift state.

After the valve body 101 is closed, the second movable core 202 and the first movable core 201 are separated from the valve body 101. Thereby, the collision energy acting on the valve body 101 and the seat member 102 when the valve is closed can be reduced by a mass of the second movable core 202 and the first movable core 201. As a result, it is possible to improve the wear resistance of the collision portion and reduce the noise caused by the valve body 101 colliding with the seat member 102.

Figure 10:
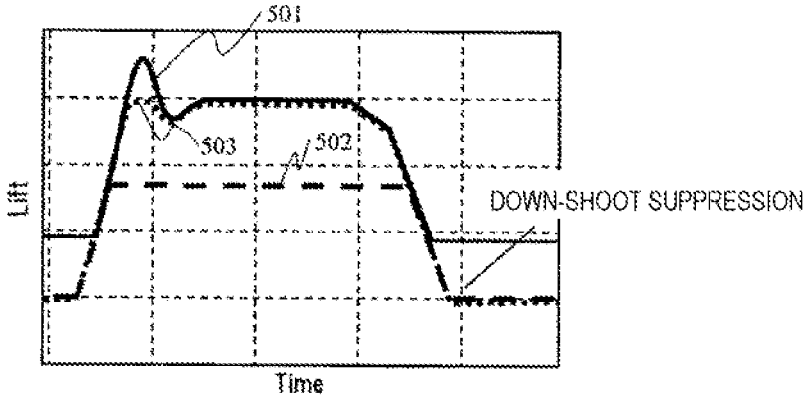
FIG. 10 is a diagram illustrating a displacement of the valve body, a displacement of the first movable core, and a displacement of the second movable core when the valve body is driven by a large lift.
Figure 11:
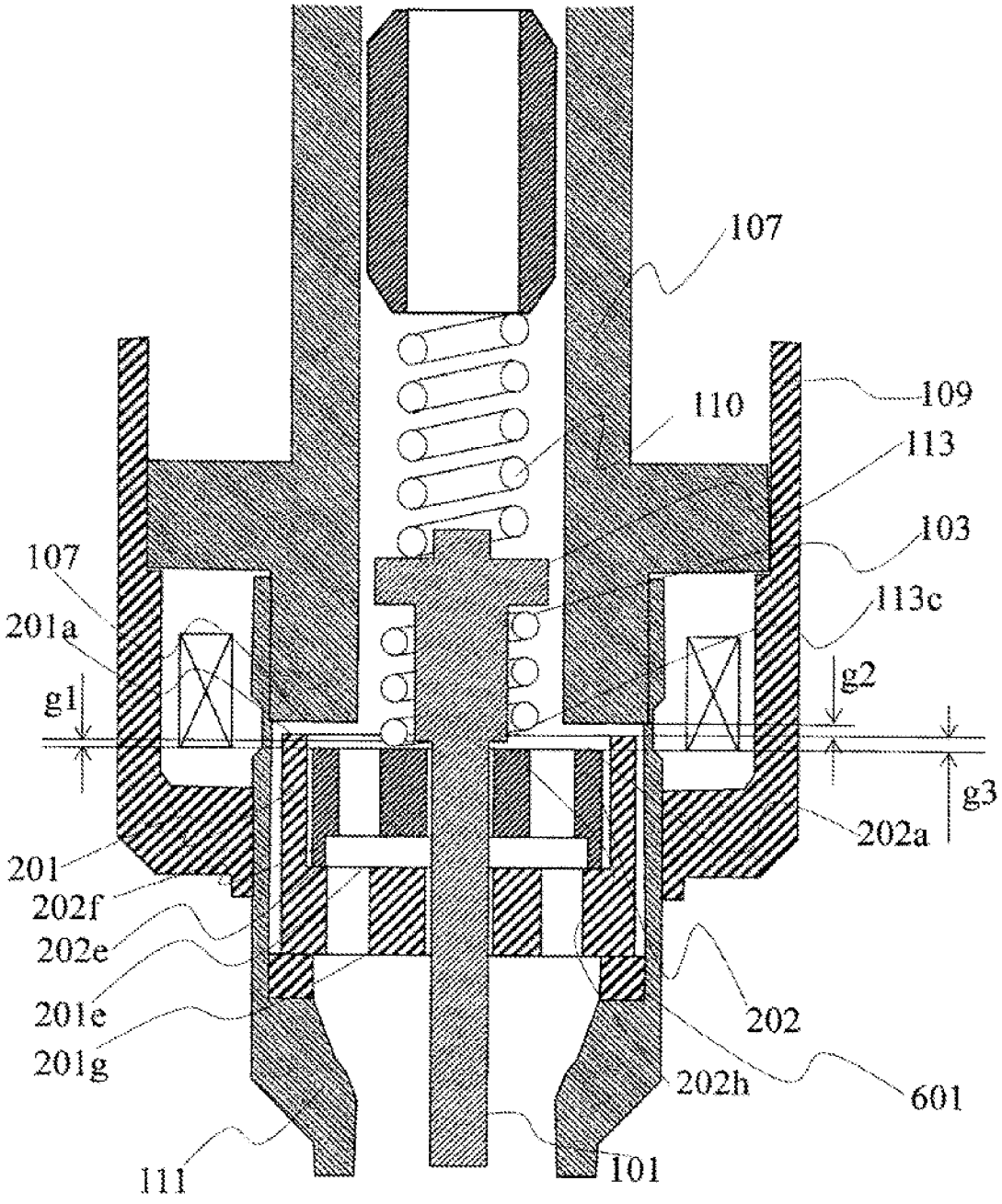
FIG. 11 is a diagram for describing a modification using a fixed member.

FIG. 10 is a diagram illustrating a displacement 501 (lift amount) of the valve body 101, a displacement 502 of the first movable core 201, and a displacement 503 of the second movable core 202 in a case where the valve body 101 is driven with a large lift. As illustrated in FIG. 10, after the first movable core 201 and the second movable core 202 are separated from the valve body 101, the bottom surface 201*g* (end surface on the downstream side) of the first movable core 201 is engaged with the storage bottom surface 111*b* of the nozzle holder 111. Then, the movement of the first movable core 201 is regulated, and the first movable core 201 comes to a standstill.

In other words, after the valve body 101 is seated on the seat member 102 and the second movable core 202 (second movable element) is separated from the sleeve 113, the bottom surface 201*g* of the first movable core 201 (first movable element) collides with the storage bottom surface 111*b* (collision receiving portion). Thereby, undershoot of the first movable core 201 and the second movable core 202 is suppressed.

Further, the storage bottom surface 111*b* (collision receiving portion) is formed by the nozzle holder 111 (cylindrical member) itself. Thereby, the number of parts can be reduced.

The movement of the second movable core 202 is attenuated by the urging force of the second spring 103 which is urged in the valve closing direction although the second movable core 202 moves to the upstream side due to collision energy generated when the first movable core 201 engages with the storage bottom surface 111*b*, so that the second movable core 202 is engaged with the first movable core 201 and enters a stationary state.

By setting the mass ratio of the first movable core 201 and the second movable core 202 to the same level (within 20%), it is possible to rapidly attenuate the movement of the first movable core 201 and the second movable core 202. As the time required for the first movable core 201 to reach the stationary state is shorter, the difference between the injection amount and the injection amount that occurs when the interval between the next injection is shortened, and the injection amount can be measured more stably.

In addition, as illustrated in FIG. 5, the width W at which the first movable core 201 and the storage bottom surface 111*b* engage is such that the damper effect by the fluid flowing through the gap between the engaging portions and the movement is not hindered when the valve is opened. It is possible to shorten the delay of the valve closing operation while securing the wear resistance of the storage bottom surface 111*b* and the bottom surface 201*g* of the first movable core 201 and low noise at the time of collision.

In order to allow the displacement of the valve body 101 to be switched between the large lift state and the small lift state by the current supplied to the fuel injection valve 100, a dimensional relation among the gap g1 between the second facing surface 202*a* of the second movable core 202 and the sleeve bottom surface 113*c* in the valve closed state, the gap g2 between the first facing surface 201*a* of the first movable core 201 and the magnetic core 107, and the gap g3 between the first facing surface 201*a* of the first movable core 201 and the second facing surface 202*a* of the second movable core 202 is set to be g2, g3, and g1 in descending order.

In this manner, the movable core group 200 is divided into the first movable core 201 and the second movable core 202, and the displacement of the valve body 101 can be changed in two stages by changing the drive current to the coil 108.

In this embodiment, the amount of intake air, the number of revolutions of the internal combustion engine, the fuel injection pressure, and the accelerator opening are sensed, and the current waveform to be supplied to the fuel injection valve is switched according to the threshold value. Even using other information, the switching may be available in a case where the same effect is obtained.

(Modifications)

In the above-described embodiment, a configuration in which the first movable core 201 and the storage bottom surface 111*b* of the nozzle holder 111 are engaged in the valve closed state as illustrated in FIG. 5 has been described as an example. The fixed member 601 may be inserted between the storage bottom surface 111*b* and the first movable core 201 so that the first movable core 201 and the fixed member 601 are engaged with each other. In other words, the fixed member 601 (collision receiving portion) is attached to the nozzle holder 111 (cylindrical member), and is configured as a separate member from the nozzle holder 111. Thereby, only the fixed member 601 can be replaced.

The magnetic characteristics of the fixed member 601 may be realized by using a material (for example, austenitic stainless steel (non-magnetic material), martensite stainless steel, or the like) having a saturation magnetic flux density smaller than that of the magnetic circuit which is configured by the nozzle holder 111 (cylindrical member), the first movable core 201 (first movable element), the second movable core 202 (second movable element), and a magnetic core 107 (fixed core).

In other words, the saturation magnetic flux density of the fixed member 601 (collision receiving portion) may be lower than the saturation magnetic flux density of the members forming the magnetic circuit.

Thereby, the magnetic attractive force generated between the first movable core 201 and the fixed member 601 can be reduced, and the reduction of the magnetic attractive force acting between the movable core group 200 and the magnetic core 107 can be suppressed. Further, the nozzle holder 111 (cylindrical member) is also configured by a member (magnetic material) that forms a magnetic circuit, so that magnetic flux easily flows between the yoke 109 (housing) and the second movable core 202 (second movable element).

Figure 12:
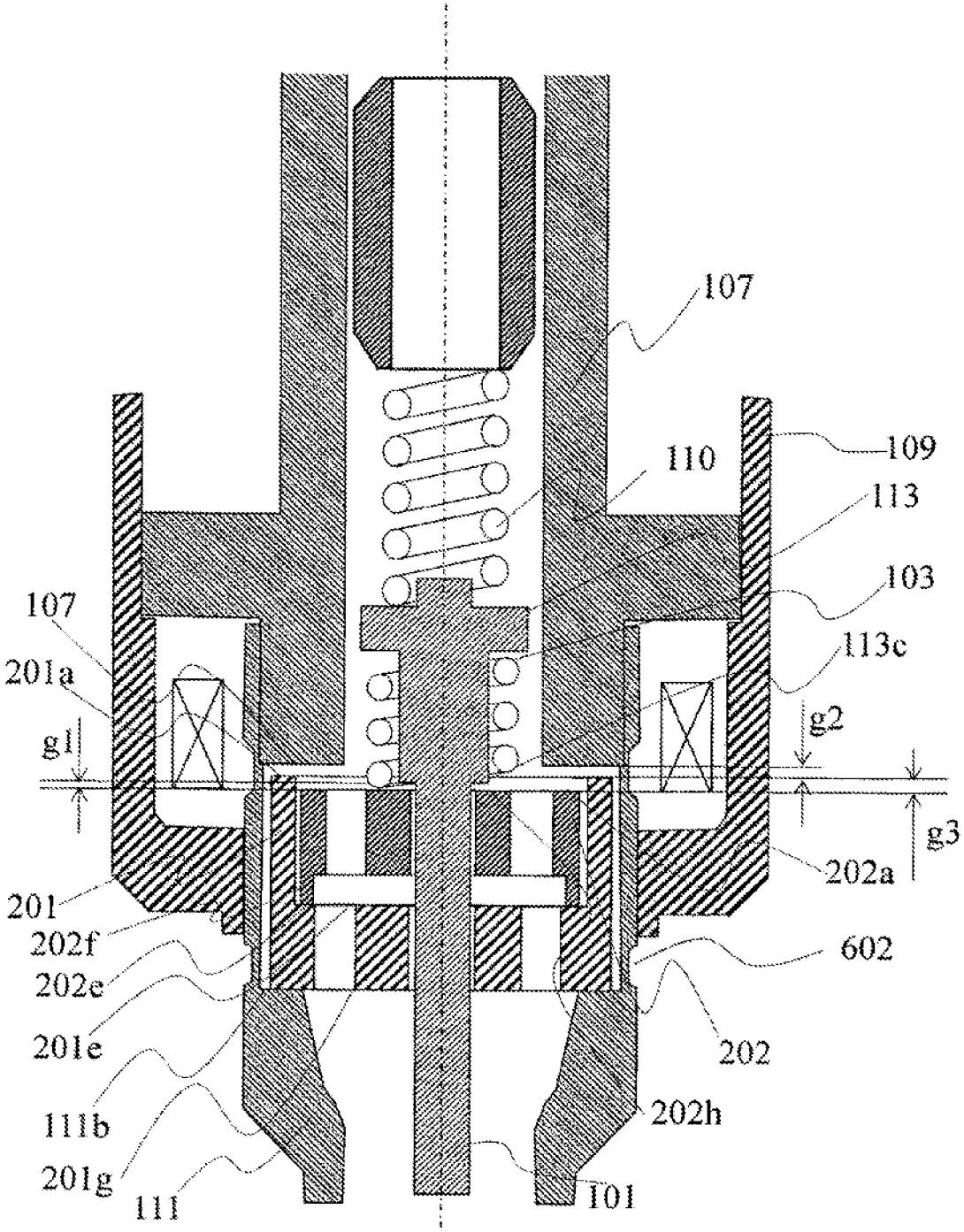
FIG. 12 is a diagram for describing a modification in which a magnetic aperture unit is provided.

Alternatively, as illustrated in FIG. 12, a magnetic aperture unit 602 may be provided on the upstream side (the coil 108 side) of the storage bottom surface 111*b* to reduce the magnetic flux passing between the first movable core 201 and the nozzle holder 111, so that the reduction of the magnetic attractive force acting between the movable core group 200 and the magnetic core 107 may be suppressed. Further, even if the magnetic aperture unit 602 is provided on the movable core group 200 side or provided on the nozzle holder side, the effect obtained is not changed, and the invention is not limited thereto.

As described above, according to this embodiment, the position of the movable element can be quickly stopped at a predetermined position after the valve is closed while reducing the impact force of the valve body.

Further, the invention is not limited to the above embodiments, but various modifications may be contained. For example, the above-described embodiments of the invention have been described in detail in a clearly understandable way, and are not necessarily limited to those having all the described configurations. In addition, some of the configurations of a certain embodiment may be replaced with the configurations of the other embodiments, and the configurations of the other embodiments may be added to the configurations of a certain embodiment. In addition, some of the configurations of each embodiment may be omitted, replaced with other configurations, and added to other configurations.

Further, the embodiment of the invention may be configured as follows.

(1) A fuel injection valve which includes a magnetic core, a first movable element (outer anchor) which is attracted to the magnetic core to lift a valve body, a second movable element (inner anchor) which is configured separately from the valve body, is attracted to the magnetic core after the first movable element (outer anchor) lifts the valve body to collide with a lift restricting portion to lift the valve body, and a collision receiving portion which collides with the downstream surface of the first movable element (outer anchor) after the valve body collides with a valve seat.

(2) In the fuel injection valve described in (1), there is provided a cylindrical member (nozzle holder) which is disposed radially outside the valve body and includes the valve body. The collision receiving portion is formed in the cylindrical member (nozzle holder) itself.

(3) In the fuel injection valve described in (1), there is provided a cylindrical member (nozzle holder) which is disposed radially outside the valve body and includes the valve body. The collision receiving portion is attached to the cylindrical member (nozzle holder), and configured by a separate member from the cylindrical member (nozzle holder).

(4) In the fuel injection valve described in (3), the collision receiving portion is formed of a member having a lower saturation magnetic flux density than a magnetic circuit component (a housing or a magnetic core).

(5) In the fuel injection valve describe in (3), the cylindrical member (nozzle holder) is arranged to form a magnetic circuit together with the magnetic core.

(6) In the fuel injection valve described in (3), the cylindrical member (nozzle holder) is arranged to overlap the first movable element (outer anchor) in an axial direction.

(7) In the fuel injection valve described in (1), the second movable element (inner anchor) is disposed in a recess formed in the first movable element (outer anchor), and is disposed such that the second gap between the second movable element (inner anchor) and the magnetic core becomes larger than the first gap between the first movable element (outer anchor) and the magnetic core when the valve is closed.

(8) In the fuel injection valve described in (1), when the first movable element (outer anchor) is attracted to the magnetic core, the first movable element (outer anchor) is engaged with the second movable element (inner), and the second movable element (inner anchor) is engaged with the valve body, so that the valve body is lifted.

(9) In the fuel injection valve described in (8), when the first movable element (outer anchor) is attracted to the magnetic core, the bottom surface of the concave portion of the first movable element (outer anchor) is engaged with the downstream surface of the second movable element (inner anchor), and the upstream surface of the second movable element (inner anchor) is engaged with the downstream surface of the valve body, so that the valve body is lifted.

(10) In the fuel injection valve described in (1), after the first movable element (outer anchor) collides with the lift restricting portion, the upstream surface of the second movable element (inner anchor) is engaged with the downstream surface of the valve body, so that the valve body is lifted and collided with the lift restricting portion.

(11) In the fuel injection valve described in (1), the valve body opened by the first movable element or the second movable element is independent of and separate from the first movable element and the second movable element.

According to the above (1) to (11), the position of the movable element is quickly stopped at a predetermined position after the valve is closed, thereby making it possible to reduce a fuel injection amount error during multiple injections.

REFERENCE SIGNS LIST

100 fuel injection valve
100*a* axial direction
101 valve body
101*b* valve body-side seat portion
102 seat member
103 second spring
107 magnetic core
108 coil
109 yoke
110 first spring
111 nozzle holder
111*a* storage portion
111*b* storage bottom surface
112 fuel supply port
112*a* fuel inlet surface
113 sleeve
113*a* convex top surface
113*b* convex bottom surface
113*c* sleeve bottom surface
115 seat portion
116 fuel injection hole
120 ECU
121 EDU
122 communication line
123 signal line
200 movable core group
201 first movable core
201*a* first facing surface
201*b* inner periphery
201*c* concave portion
201*d* fuel passage hole
201*e* concave bottom surface
201*g* bottom surface
202 second movable core
202*a* second facing surface
202*b* outer periphery
202*d* fuel passage hole
202*e* bottom surface
202*f* protrusion
202*g* gap
202*h* upstream side engaging portion
202*i* concave portion
401 maximum drive current
403 valve body displacement
404 maximum drive current
406 valve displacement
501 displacement
502 displacement
503 displacement
601 fixed member
602 magnetic aperture unit
1131 cylindrical portion
1132 convex portion

The invention claimed is:

1. A fuel injection valve, comprising:
a valve body having a sleeve;
a seat member on that the valve body is seated;
a magnetic core;
a first movable element that lifts the valve body by an attractive force of the magnetic core;
a second movable element that is configured separately from the valve body and further lifts the valve body by the attractive force of the magnetic core after the first movable element lifts the valve body; and
a collision receiving portion that collides with a bottom surface of the first movable element after the valve body is seated on the seat member and the second movable element separates from the sleeve.

2. The fuel injection valve according to claim 1, further comprising:
a cylindrical member that includes the valve body,
wherein the collision receiving portion is formed by the cylindrical member itself.

3. The fuel injection valve according to claim 1, further comprising:
a cylindrical member that includes the valve body,
wherein the collision receiving portion is attached to the cylindrical member and configured as a separate member from the cylindrical member.

4. The fuel injection valve according to claim 3,
wherein a saturation magnetic flux density of the collision receiving portion is lower than the saturation magnetic flux density of the members of the magnetic circuit.

5. The fuel injection valve according to claim 3,
wherein the cylindrical member forms a magnetic circuit together with the first movable element, the second movable element, and the magnetic core.

6. The fuel injection valve according to claim 1,
wherein the second movable element is disposed in a concave portion formed in the first movable element, and
wherein, when the valve is closed, a second gap between the second movable element and the magnetic core is larger than a first gap between the first movable element and the magnetic core.

7. The fuel injection valve according to claim 1,
wherein, when the first movable element is attracted to the magnetic core, the first movable element is engaged with the second movable element, and the second movable element is engaged with the valve body, so that the valve is lifted.

8. The fuel injection valve according to claim 7,
wherein, when the first movable element is attracted to the magnetic core, a bottom surface of the concave portion formed in the first movable element engages with a bottom surface of the second movable element, and a top surface of the second movable element engages with a bottom surface of the sleeve of the valve body, so that the valve body is lifted.

9. The fuel injection valve according to claim 1,
wherein, after the first movable element lifts the valve body, a top surface of the second movable element engages with a bottom surface of the sleeve of the valve body, so that the valve body is lifted.

10. The fuel injection valve according to claim 1,
wherein the valve body is separate from the first movable element and the second movable element.

* * * * *